United States Patent [19]

Heckman

[11] 4,145,231

[45] Mar. 20, 1979

[54] FILM DRIVEN FILM CLEANER

[75] Inventor: Harry W. Heckman, Seaford, N.Y.

[73] Assignee: B-H Instrument Company, Inc., Massapequa, N.Y.

[21] Appl. No.: 843,583

[22] Filed: Oct. 19, 1977

Related U.S. Application Data

[63] Continuation of Ser. No. 713,588, Aug. 11, 1976, abandoned.

[51] Int. Cl.[2] ..... B08B 1/02

[52] U.S. Cl. ..... 134/9; 15/100; 15/103.5; 352/130

[58] Field of Search ..... 134/9; 15/100, 103.5; 352/129, 130

[56] References Cited

U.S. PATENT DOCUMENTS

| | | | |
|---|---|---|---|
| 1,857,633 | 5/1932 | Gramsa | 352/130 |
| 1,914,890 | 6/1933 | Mackler | 15/100 |
| 3,266,196 | 8/1966 | Barcaro | 15/100 UX |
| 3,507,569 | 4/1970 | Goto | 352/129 |
| 3,641,605 | 2/1972 | Lindsay | 15/100 X |
| 3,778,139 | 12/1973 | Kelly | 352/130 |

*Primary Examiner*—Marc L. Caroff

*Attorney, Agent, or Firm*—Charles B. Smith; Robert R. Jackson

[57] ABSTRACT

A film cleaner and method for cleaning motion picture film. The cleaner includes a friction-driven roll, spools of cleaning tape, take-up rolls to draw the tapes from the spools, means for contacting the tapes with the film, and a gearing mechanism connecting the friction-driven roll with the take-up rolls. The film cleaning method includes driving the friction-driven roll with film running through a film delivery and take-up system, contacting the surfaces of the film with the cleaning tapes, and transferring the movement of the friction-driven roll into movement of the take-up rolls to draw the tapes from the spools. Thus, the take-up rolls are driven by the friction-driven roll and essentially clean portions of the tapes contact the film.

15 Claims, 5 Drawing Figures

FILM DRIVEN FILM CLEANER

This is a continuation, of application Ser. No. 713,588, filed Aug. 11, 1976, now abandoned.

BACKGROUND OF THE INVENTION

This invention relates to a device for cleaning motion picture film and a method of its use. More particularly, the invention relates to a film cleaner operated by the film being cleaned.

It is desirable to provide a film cleaner which may be used with facility as an attachment to a motion picture film projecting machine, which will effectively remove oily or gummy matter or dust adhering to the surfaces of the film without creating any destructive stress in the film, and which provides for ready renewal of its cleaning elements. In the past, film cleaning devices have utilized stationary cleaning elements. Consequently, these devices maintain the same cleaning surface in constant contact with the film until the elements are removed and either reversed or replaced by clean ones. If such reversal or replacement is neglected, the matter which accumulates on the film surfaces renders the cleaning elements less efficient and also renders the film liable to damage.

To solve this problem, devices having a constantly changing supply of cleaning material are utilized. The cleaning material, as part of a cleaning device, is generally incorporated into a motion picture film apparatus, such as a projector. Generally, means such as a projector powered sprocket or take-up reel, are utilized to drive the film cleaning device so that a relatively clean surface of the cleaning material is kept in constant contact with the film as it is run through the projector onto the take-up reel.

Although this type of film cleaner is advantageous over the stationary type of cleaner, it still requires that it be driven by power derived from the projector through which the film being cleaned is run. This requirement necessitates mechanisms and equipment for integrating the film cleaner into the projector and limits the versatility of the manner in which the cleaner may be used.

An improved film cleaner is provided by the present invention, which cleaner is not powered by a projector, but by film being cleaned.

The advantages of the film cleaner of the present invention are that this cleaner can easily be incorporated into a film delivery and take-up system without the need for extensive equipment, can easily be moved to different areas of the system, and can easily be disengaged from the system, if cleaning is not desired, without modification of the system itself.

SUMMARY OF THE INVENTION

In accordance with this invention, a film cleaner is positioned in the film path of film moving through a film delivery and take-up system, which system has means such as a projector for moving film along the path. The cleaner includes a friction-driven roll driven solely by frictional contact of a side surface of the film moving along the path through the system, a spool of cleaning tape for each surface of the film to be cleaned, a take-up roll for each spool to draw the cleaning tape from the spool, means for contacting each tape with a surface of the film, and a gearing mechanism connecting the friction-driven roll with the take-up rolls. As used herein with reference to the film, the terms "surface" and "side surface" are synonymous and refer to either of the two principal surfaces of the film perpendicular to the edges of the film which define the sprocket holes and film margins. Preferably, the cleaner includes means for its mounting to the equipment of the system in the film path and generally a housing on which the above recited structures are mounted, which housing is also mountable on the equipment of the system. Also, the cleaner preferably includes film rollers around which the film moves in the film path. One film roller is positioned upstream of the friction-driven roll and another film roller is positioned downstream of the means for contacting the tapes with the surfaces of the film, whereby the film moves in the film path around the upstream roller before it is cleaned and around the downsteam film roller after it is cleaned.

In accordance with this invention, a method of using the film cleaner includes driving the friction-driven roll solely by frictional contact of a side surface of the film running through a film delivery and take-up system, contacting the surfaces of the film with the cleaning tapes, and transferring the movement of the friction-driven rolls into movement of the take-up rolls to draw the tapes from the spools. Thus, the take-up rolls are driven by the friction-driven roll and essentially clean portions of the tapes contact surfaces of the film. Preferably, the speed of movement of the take-up roll is reduced as compared to the speed of movement of the friction-driven roll as the movement of the friction-driven roll is transferred to the take-up rolls.

DESCRIPTION OF THE PREFERRED EMBODIMENTS

The film cleaner of the present invention may be used in several types of film delivery and take-up systems. Examples of such systems are a projector with delivery and take-up reels, a projector with a delivery and take up platter system, or a film rewinding system. Hereinafter the film delivery and take-up system in which the cleaner is useful will be generally referred to as a "projector."

Figure 1:
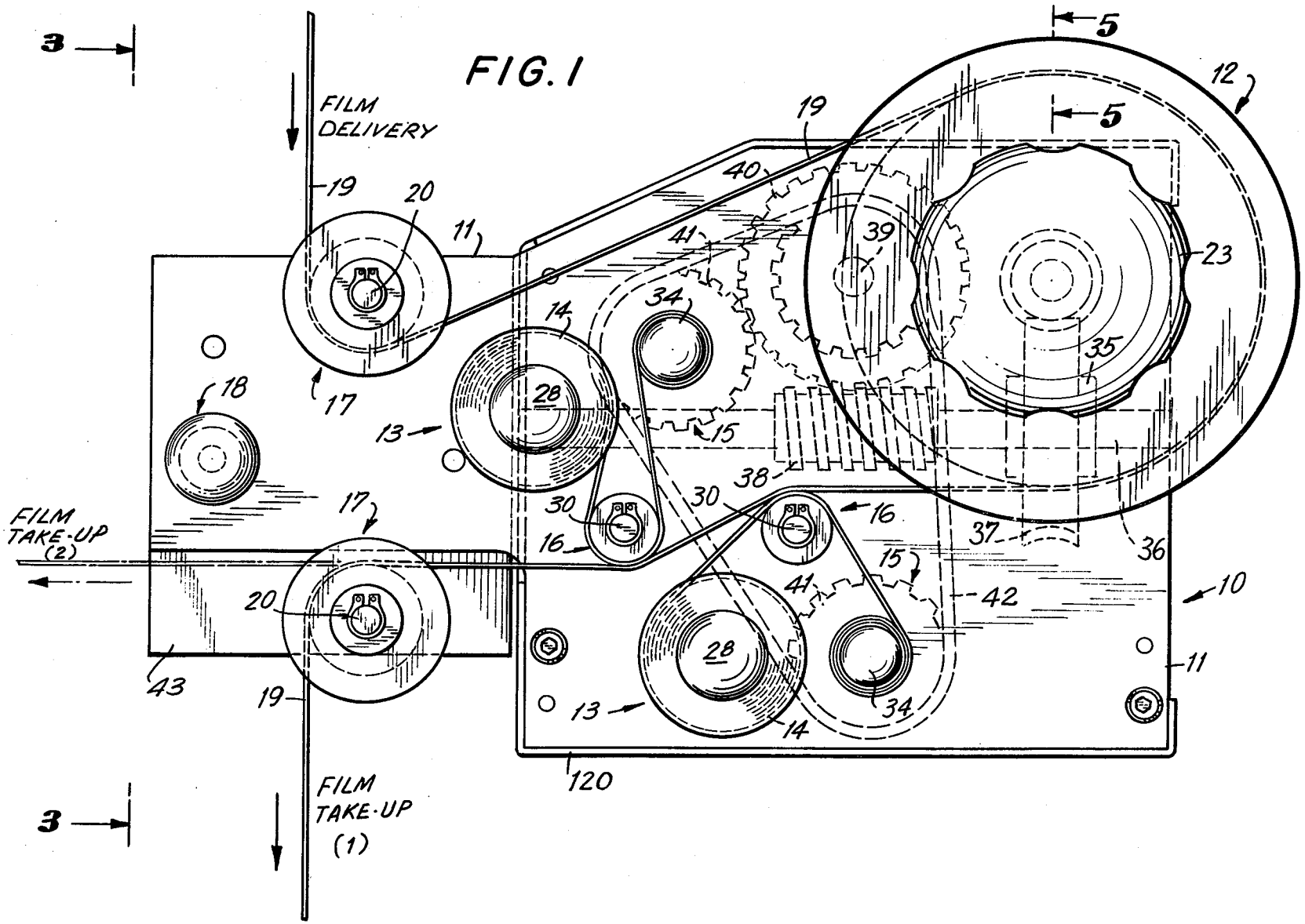
FIG. 1 is a top plan view of an embodiment of the film cleaner of the present invention, which view shows in dotted line structures of the cleaner shown from a different view in FIG. 2.

Referring to FIG. 1, the film cleaner of the present invention includes a housing, generally indicated at 10. The housing includes a first encasing structure 11 about which the elements of the film cleaner are mounted, as described in detail below. The housing also includes a second encasing structure 120 which surrounds portions of structure 11 to enclose those elements of the cleaner mounted within structure 11. Essentially, the cleaner is constructed in this manner so that structure 120 which is secured to structure 11 by conventional screw threads may be removed for viewing those elements of the cleaner enclosed within structure 11.

Figure 2:
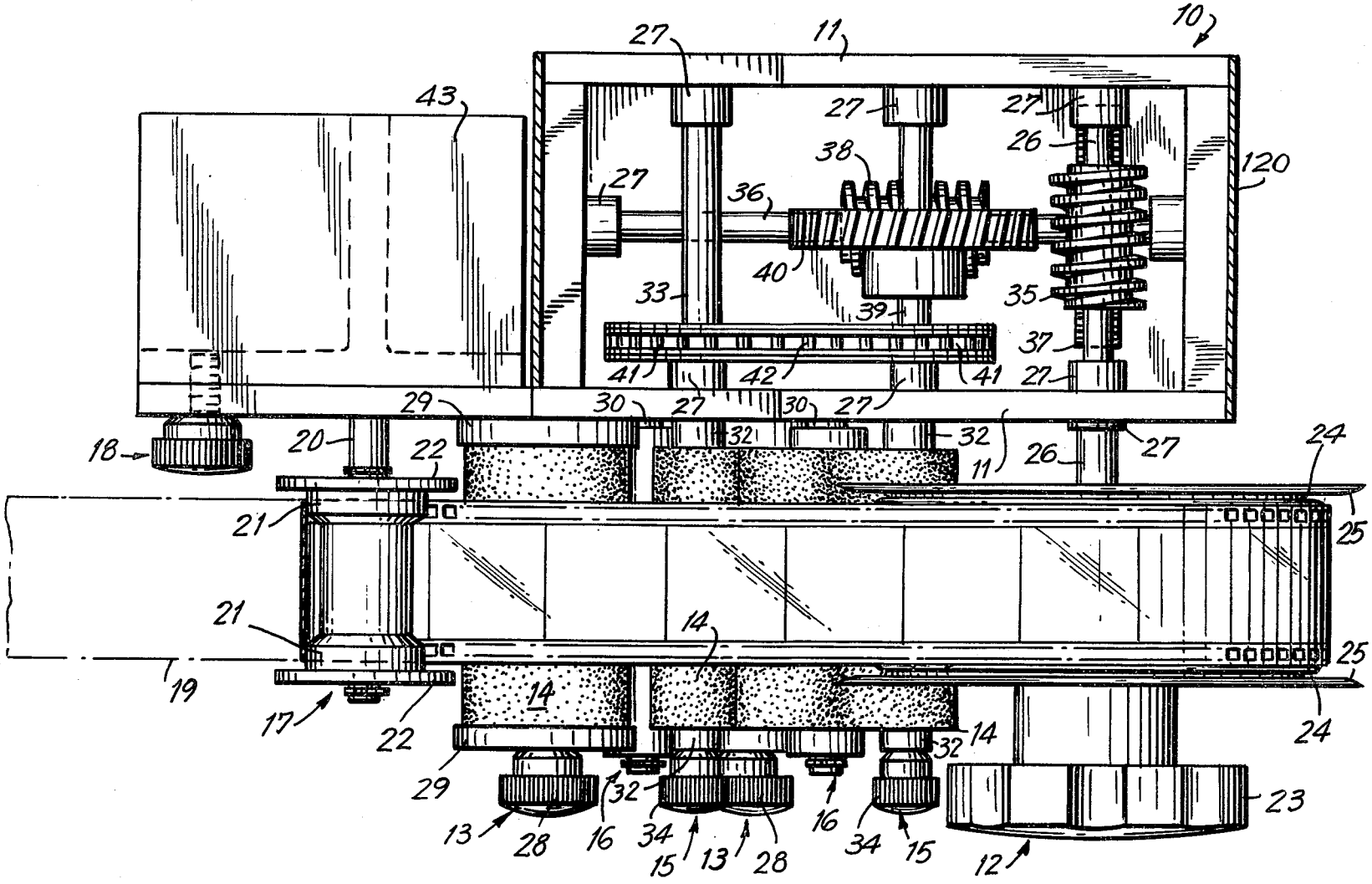
FIG. 2 is a side view of the cleaner illustrated in FIG. 1.
Figure 3:
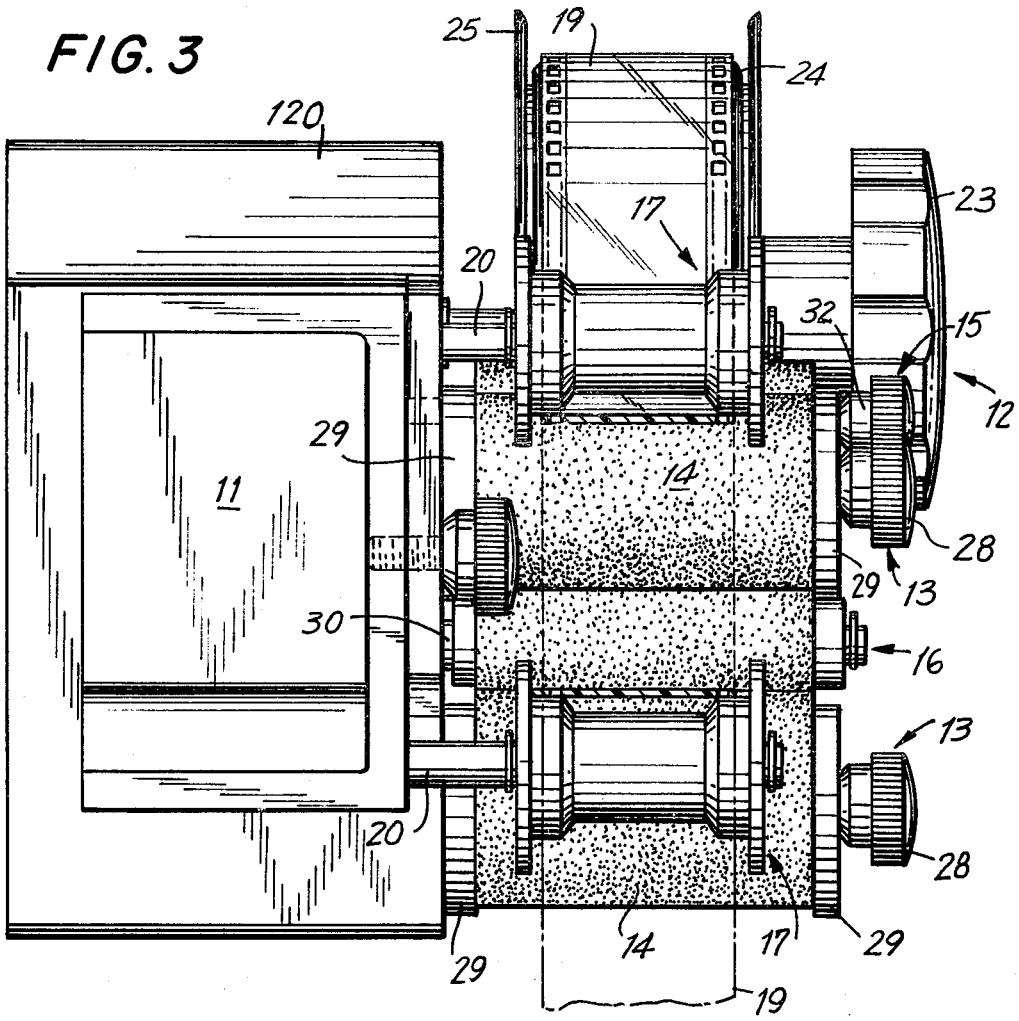
FIG. 3 is a view of the cleaner illustrated in FIG. 1 taken along lines 3—3 of FIG. 1.

Again referring to FIG. 1, the film cleaner shown includes a large, friction-driven roll 12, two spools 13, each having a cleaning tape 14 wound therearound, two take-up rolls 15, rollers 16, around which tapes 14 are drawn, rollers 17, and a large screw 18 which threads through encasing structure 11 of housing 10 to provide a means for securing the cleaner to a projector. Also illustrated in FIG. 1 is film 19. The film is shown as it would move through the cleaner from a projector (not shown) to a take-up reel (not shown). Referring to FIGS. 1 and 2, the above mentioned elements will be described in accordance with the path of movement of film 19 through the cleaner. As shown in FIG. 1, film 19 moving from the projector first moves around roller 17.

Roller 17 is mounted on a shaft 20 to be freely rotatable about the shaft. The roller has film supporting surfaces 21 and outer film guides 22, which insure the correct alignment of the film on surfaces 21 as the film moves through the cleaner towards the friction-driven roll 12.

Figure 5:
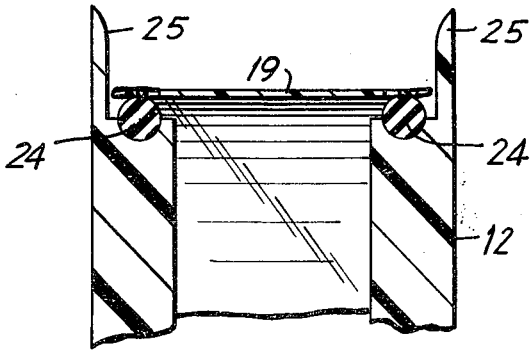
FIG. 5 is a view of the cleaner of FIG. 1 taken along lines 5—5 of FIG. 1.

Roll 12, as shown in FIG. 2, includes a handle 23, cylindrical circumferential film supporting surfaces 24, and film guides 25. Roll 12 is also mounted on a shaft, but the shaft 26 on which it is fixedly mounted is journaled for rotation in housing 10 through a sleeve 27 fixedly mounted in encasing structure 11. As shown particularly in FIG. 5, film 19 runs over film supporting surfaces 24 between film guides 25 with a side surface of the film in contact with film supporting surfaces 24. Roll 12, or at least the film supporting surfaces 24 of roll 12, may be made from any of several conventional materials known in the art for use in making such rolls, as long as the roll or surfaces when in contact with film moving through the cleaner effect frictional engagement with the side surface of the film to result in driving of roll 12 solely by this frictional engagement of the film.

Again referring to FIG. 1, downstream of roll 12, in the path of the film moving through the cleaner, are the cleaning elements of the device of the present invention.

A cleaning tape 14, prior to operation of the cleaner, is wound about each spool 13. The cleaning tape is preferably made of a material having two surfaces that are useful for cleaning film. The tape may be a material such as one available from the Minnesota Mining and Manufacturing Company, St. Paul. Minn., identified as a "WIPING FABRIC, Model 523W," a silicone-treated material, several of which are commercially available for cleaning film under laboratory conditions, or another type of material known in the art for such use. Each spool 13 includes a cap 28, a spool cover 29 at each end of the spool, a cardboard cylinder about which the tape is wound, and a shaft (not shown) fixedly mounted in housing 10. The shaft and cap 28 have compatible threaded screw and opening structures so that the tape can be removed from the spool after usage.

As shown best in FIG. 1, tape 14 drawn off spool 13 is wound around roller 16 and onto take-up roll 15. Roller 16 is freely rotatable about a shaft 30 fixedly journaled in housing 10. As discussed in greater detail below, roller 16 positions tape 14 for contact with the film.

The remaining cleaning element shown in FIGS. 1 and 2 is take-up roll 15. In the manner discussed below, when film is run through the cleaner take-up roll 15 draws cleaning tape 14 off spool 13 to provide clean portions of the tape in contact with the film. Take-up roll 15 includes cardboard cylinder 31 about which the other end of tape 14 is wound, clamping means 32, and a shaft 33. Similar to spool 13, take-up roll 15 is provided with a cap 34 and threaded screw and opening structures in cap 34 and shaft 33, which facilitate removal of tape 14 from roll 15 after usage. The clamping means 32, which rotate with shaft 13, prevent the cardboard cylinder about which tape 14 is wound from freely rotating. Thus, as take-up roll 15 is rotated to draw tape 14 from spool 13, the cardboard cylinder similarly rotates.

As mentioned above and shown particularly in FIG. 1, the film cleaner includes two of each of the spools, rollers, and take-up rolls. Each set of cleaning elements is positioned in the film path to contact a surface of the film as the film moves from the friction-driven roll 12 to another roller 17, similar to roller 17 discussed above. Thus, the film cleaned by the cleaning elements moves around roller 17 and is drawn to a take-up reel.

The take-up reel essentially moves the film being cleaned through the film path of the projector. However, the cleaning elements described above are not operated to provide clean portions of the tapes in contact with the surfaces of the film by the take-up reel, but by friction-driven roll 12.

To accomplish driving of take-up rolls 15 by friction-driven roll 12, a gearing mechanism is provided. The mechanism connects roll 12 with rolls 15 for transferring movement of the friction-driven roll as it is driven by the film into movement of the take-up rolls to draw tapes 14 from spools 13. Thus, the take-up rolls are driven by roll 12 and essentially clean portions of tapes 14 contact the film for cleaning it. Preferably, the gearing mechanism also includes means for reducing the speed of movement of the take-up rolls as compared to the speed of movement of the friction-driven roll to result in a ratio of about 1 to 10,000.

Referring again to FIG. 2, a gear 35, such as a worm gear, is fixedly mounted on shaft 26. Then upon rotation of friction-driven roll 12 by the film, shaft 26 and gear 35 rotate. Another shaft 36 rotatably mounted perpendicular to shaft 26 in housing 10 is also provided. Mounted for rotation on shaft 36 adjacent gear 35 is another gear 37, which is best shown in FIG. 1. Upon rotation of shaft 26 and gear 35, gear 37 and shaft 36 are rotated because of the intermeshing of the teeth of gear 35 into the teeth of gear 37. Mounted behind and away from housing 10 on shaft 36 is another gear 38, which may also be a worm gear.

To transfer movement of shaft 36 and gear 38 originating from the movement of friction-driven roll 12, another gearing element is provided. First, a shaft 39 is mounted in housing 10 perpendicular to shaft 36. On shaft 39, a gear 40, preferably similar to gear 37, is mounted for rotation. Gear 40 has teeth, as shown in FIG. 2, which intermesh with the teeth of gear 38 to cause rotation of a sprocket 41, which is fixedly mounted on shaft 39 for rotation.

As discussed above, each take-up roll 15 is mounted on a shaft 33. Also mounted on each shaft 33 is a sprocket 41, similar to sprocket 41 mounted on shaft 39. Provided to connect the sprockets 41 is a chain 42. This engagement of sprockets 41 by chain 42 is best seen in FIG. 1. Thus, it is apparent that movement of friction-driven roll 12 results in gearing between the various gears described above to result in a similar movement of take-up rolls 15. It is contemplated to be within the scope of this invention that the gear ratios and dimensions of the various gears mentioned above be set to result in a speed reduction means between the friction-driven roll 12 and take-up rolls 15. Thus, tapes 14 on the take-up rolls 15 need not be moved as quickly as the film moving along the film path through the cleaner.

Several modifications of the structures described above and, in general, of the film cleaner of this invention are contemplated.

Although the film cleaner is illustrated in the drawings as being positioned between the projector and take-up reel, it is to be understood that this cleaner can be moved around in the projecting apparatus to clean the film running therethrough at various points. Particularly, this is true because the cleaner is preferably encased in housing 10, so as to be easily connected with and/or be disengaged from the projector. As shown in FIG. 1, roller 17, positioned in the cleaner to accept the film moving from the cleaning elements to the take-up reel, is mounted on a bracket 43, which roller and bracket can both be eliminated. The film can run directly to the take-up reel, as indicated at (2) in FIG. 1. Also, housing 10 is preferably utilized, but the above-discussed elements of the film cleaner may otherwise be secured directly to the projector.

Figure 4:
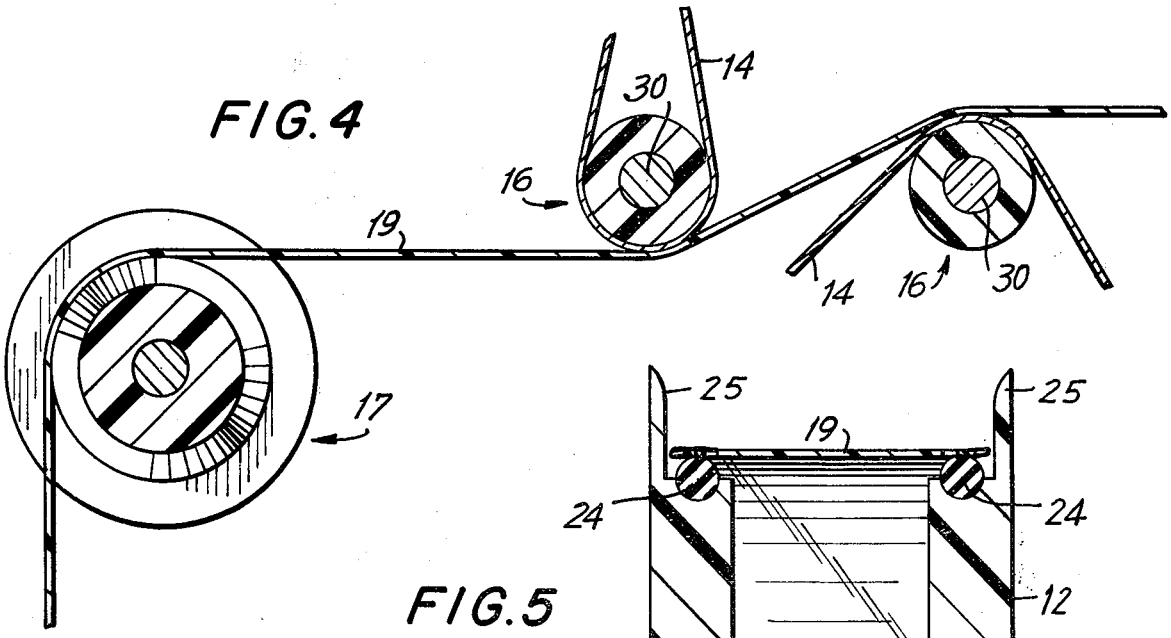
FIG. 4 is a schematic illustration of a portion of the film path and film running therethrough shown in FIG. 1.

Referring to FIG. 4, film 19 moves in essentially a sinuous path between rollers 16 to effect contact with tapes 14 drawn around the rollers. It is contemplated that rollers 16 or other means for contacting the tapes with the surfaces of the film could be eliminated, but such elimination would not result in a film cleaning device as efficient as the one shown. For instance, take-up rolls 15 could serve both functions of drawing the tapes off spools 13 and of contacting the tapes with the surfaces of the film. However, in this event, the tape being drawn onto a take-up roll would push the film as it contacted the take-up roll out of its normal path, which could cause problems or destruction of the film if the film were not sufficiently slack.

It is also contemplated that only one tape be utilized to clean one surface of the film. In this event, one take-up roll 15 and spool 13 could be eliminated and even one roller 16 could be eliminated if the arrangement of the above discussed elements was made to effect contact of the film with the remaining roller 16. Finally, it is to be understood that once the cleaner is operated and the tapes have been drawn off the spools onto the take-up rolls, only one cleaning surface of each of the tapes will have been utilized. To use the other surface, the tape utilized in conjunction with one of the spools and take-up rolls can be switched with the tape utilized in conjunction with the other of the spools and take-up rolls, so that both cleaning surfaces of each tape are used.

Other modifications to the film cleaner described above and other embodiments of this cleaner will be apparent to one skilled in the art after reading of this disclosure.

What is claimed is:

1. A film cleaner for cleaning film moving along a path in a film delivery and take-up system, said film delivery and take-up system including means for moving the film along the film path, comprising a first roll rotatably mounted on its axis and having a cylindrical circumferential surface for frictionally engaging a side surface of the moving film;

means for holding a side surface of the film in contact with the cylindrical surface of the first roll so that the first roll is rotated about its axis solely by frictional engagement of the side surface of the film in contact with the cylindrical surface of the roll;

a spool of cleaning tape for each surface of the film to be cleaned;

a take-up roll for each spool to draw the tape from the spool;

means for contacting the tape with the surface of the film to be cleaned; and a gearing mechanism connecting the first roll with the take-up roll for transferring movement of the first roll as it is driven by the film into movement of the take-up roll to draw the tape from the spool, whereby the take-up roll is driven by the film-driven, first roll and an essentially clean portion of the tape contacts the film moving along the path.

2. The cleaner of claim 1 wherein said means for holding a side surface of the film in contact with the cylindrical surface of the first roll comprises film rollers around which the film moves in the film path, one of the film rollers being upstream of the first roll and another of the film rollers being downstream of the means for contacting the tape with a surface of the film in the path, whereby the film moves in the film path around the upstream film roller before it is cleaned and around the downstream film roller after it is cleaned.

3. The cleaner of claim 1 further comprising a housing on which the first roll, means for holding a side surface of the film in contact with the first roll, spool, take-up roll, means for contacting the tape with a surface of the film, and gearing mechanism are mounted, the housing being mounted on the film delivery and take-up system.

4. The cleaner of claim 1 further comprising first and second spools of cleaning tape for cleaning both surfaces of the film, first and second take-up rolls for the spools, first and second means for contacting each of the tapes with a respective one of the surfaces of the film, and wherein the gearing mechanism connects the first roll with the first and second take-up rolls.

5. The cleaner of claim 1 wherein the means for contacting the tape with a surface of the film is a tape roller around which the tape is drawn from the spool onto the take-up roll, the tape roller being situated in the film path so that the tape drawn therearound contacts the film.

6. The cleaner of claim 1 wherein the gearing mechanism comprises a first shaft on which the first roll is mounted for rotation, a second shaft on which the take-up roll is mounted for rotation, gears journaled on each of the shafts, and means connecting the gears, so that movement of the first roll causes movement of the take-up roll.

7. The cleaner of claim 1 wherein the gearing mechanism comprises means for reducing the speed of movement of the take-up roll as compared to the speed of movement of the first roll.

8. The cleaner of claim 4 wherein the first and second means for contacting each of the tapes with a surface of the film are first and second tape rollers around which each of the tapes are drawn from the first and second spools onto the first and second take-up rolls, the tape rollers being situated in the film path so that each of the tapes drawn therearound contacts a respective one of the surfaces of the film.

9. The cleaner of claim 8 wherein the gearing mechanism comprises a first shaft on which the first roll is mounted for rotation, a second shaft on which the first take-up roll is mounted for rotation, a third shaft on which the second take-up roll is mounted for rotation, gears journaled on each of the shafts, and means connecting the gears, so that movement of the first roll causes movement of the first and second take-up rolls.

10. The cleaner of claim 9 wherein the gearing mechanism further comprises means for reducing the speed of movement of the first and second take-up rolls as compared to the speed of movement of the first roll.

11. The cleaner of claim 10 wherein said means for holding a side surface of the film in contact with the cylindrical surface of the first roll comprises film rollers around which the film moves in the film path, one of the film rollers being upstream of the first roll and another of the film rollers being downstream of the first and second means for contacting each of the tapes with a surface of the film, whereby the film moves in the film path around the upstream film roller before it is cleaned and around the downstream film roller after it is cleaned.

12. The cleaner of claim 11 further comprising a housing on which the first roll, means for holding a side surface of the film in contact with the first roll, spools, take-up rolls, first and second means for contacting the tapes with the surfaces of the film, and gearing mechanism are mounted, the housing being mounted on the film delivery and take-up system.

13. A method of cleaning film moving along a path in a film delivery and take-up system, said film delivery and take-up system including means for moving the film along the film path, comprising the steps of driving a first roll rotatably mounted on its axis in the film path by holding a side surface of the film in contact with a cylindrical circumferential surface of the first roll so that the first roll is rotated about its axis solely by frictional engagement of the side surface of the film in contact with the cylindrical surface of the roll;

contacting each surface of the film to be cleaned with a cleaning tape, the tape being wound at one end on a spool and at the other end on a take-up roll;

driving a gearing mechanism by connecting the gearing mechanism to the driven first roll; and driving the take-up roll by connecting the take-up roll to the driven gearing mechanism to draw the tape from the spool;

whereby the take-up roll is driven by the film-driven, first roll and an essentially clean portion of the tape contacts the film moving along the path.

14. The method of claim 13 further comprising reducing the speed of movement of the take-up roll as compared to the speed of movement of the first roll.

15. The method of claim 13 further comprising drawing the tape from the spool around a tape roller and onto the take-up roll, the tape roller being situated in the film path so that the tape drawn therearound contacts the surface of the film.

* * * * *